US006419445B1

(12) United States Patent
Burdgick

(10) Patent No.: US 6,419,445 B1
(45) Date of Patent: Jul. 16, 2002

(54) APPARATUS FOR IMPINGEMENT COOLING A SIDE WALL ADJACENT AN UNDERCUT REGION OF A TURBINE NOZZLE SEGMENT

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/546,766

(22) Filed: Apr. 11, 2000

(51) Int. Cl.[7] ..... F01D 9/06

(52) U.S. Cl. ..... 415/116; 415/139

(58) Field of Search ..... 415/114, 115, 415/116, 117, 138, 139; 416/96 R, 96 A, 97 R

(56) References Cited

U.S. PATENT DOCUMENTS

| | | | | | |
|---|---|---|---|---|---|
| 3,807,892 | A | * | 4/1974 | Frei et al. | 415/116 |
| 5,116,199 | A | * | 5/1992 | Ciokajlo | 415/116 |
| 5,823,741 | A | * | 10/1998 | Predmore et al. | 415/139 |
| 6,126,389 | A | * | 10/2000 | Burdgick | 415/115 |

OTHER PUBLICATIONS

"39$^{th}$ GE Turbine State–of–the–Art Technology Seminar", Tab 1, ""F" Technology –the First Half–Million Operating Hours", H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines –Design and Operating Features", M. W. Horner, Aug. 1996.

"39th GE Turbine State–of–the–Art Technology Seminar", Tab 7, "Advance Gas Turbine Materials and Coatings", P. W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

"39th GE Turbine State–of–the–Art Technology Seminar", Tab 10, "Gas Fuel Clean–Up System Design Considerations for GE Heavy–Duty Gas Turbines", C. Wilkes, Aug. 1996.

(List continued on next page.)

*Primary Examiner*—Christopher Verdier
(74) *Attorney, Agent, or Firm*—Nixon & Vanderhye

(57) ABSTRACT

A gas turbine nozzle segment has outer and inner bands and vanes therebetween. Each band includes a side wall, a cover and an impingement plate between the cover and nozzle wall defining two cavities on opposite sides of the impingement plate. Cooling steam is supplied to one cavity for flow through apertures of the impingement plate to cool the nozzle wall. The side wall of the band and inturned flange define with the nozzle wall an undercut region. Slots are formed through the inturned flange along the nozzle side wall. A plate having through-apertures extending between opposite edges thereof is disposed in each slot, the slots and plates being angled such that the cooling medium exiting the apertures in the second cavity lie close to the side wall for focusing and targeting cooling medium onto the side wall.

10 Claims, 2 Drawing Sheets

OTHER PUBLICATIONS

"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, " J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program –Conceptual Design and Product Development", Annual Report, Sep. 1, 1994 –Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report No. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advances Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century –"H" Gas Turbine Combined Cycles", Thomas C. Paul et al., Report,.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D. W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct.,1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al. pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames of Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov.,1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp.189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine –High Efficiency, Low Cost of Electricity and Low Emissions", Roger Schonewald and Patrick Marolda, (no date available),.
"Testing Program Results Validate GE's H Gas Turbine –High Efficiency, Low Cost of Electricity and Low Emissions", Slide Presentation –working draft, (no date available).
"The Next Step In H... For Low Cost Per kW–Hour Power Generation", LP–1 PGE '98.
"Utility Advanced Turbine System (ATS) Technology Readiness Testing and Pre–Commercialization Demonstration", Document #486040, Oct. 1 –Dec. 31, 1996, Publication Date, Jun. 1, 1997, Report Numbers: DOE/MC/31176—5628,.
"Utility Advanced Turbine System (ATS) Technology Readiness Testing —Phase 3", Document #666274, Oct. 1, 1996–Sep. 30, 1997, Publication Date, Dec. 31, 1997, Report Numbers: DOE/MC/31176–10.
"Utility Advanced Turbine System (ATS) Technology Readiness Testing and Pre–Commercial Demonstration, Phase 3", Document #486029, Oct. 1 –Dec. 31, 1995, Publication Date, May 1, 1997, Report Numbers: DOE/MC/31176—5340.
"Utility Advanced Turbine System (ATS) Technology Readiness Testing and Pre–Commercial Demonstration –Phase 3", Document #486132, Apr. 1 –Jun. 30, 1976, Publication Date, Dec. 31, 1995, Report Numbers: DOE/MC/31176—5660.
"Utility Advanced Turbine System (ATS) Technology Readiness Testing and Pre–Commercial Demonstration —Phase 3", Document #587906, Jul. 1 –Sep. 30, 1995, Publication Date, Dec. 31, 1995, Report Numbers: DOE/MC/31176—5339.
"Utility Advanced Turbine System (ATS) Technology Readiness Testing and Pre–Commercial Demonstration" Document #666277, Apr. 1 –Jun. 30, 1997, Publication Date, Dec. 31, 1997, Report Numbers: DOE/MC/31176—8.

"Utility Advanced Turbine System (ATS) Technology Readiness Testing and Pre–Commercialization Demonstration" Jan. 1 –Mar. 31, 1996, DOE/MC/31176—5338.

"Utility Advanced Turbine System (ATS) Technology Readiness Testing: Phase 3R", Document #756552, Apr. 1 –Jun. 30, 1999, Publication Date, Sep. 1, 1999, Report Numbers: DE—FC21–95MC31176–23.

"Utility Advanced Turbine System (ATS) Technology Readiness Testing.", Document #656823, Jan. 1 –Mar. 31, 1998, Publication Date, Aug. 1, 1998, Report Numbers: DOE/MC/31176–17.

"Utility Advanced Turbine Systems (ATS) Technology Readiness Testing and Pre–Commercial Demonstration", Annual Technical Progress Report, Reporting Period: Jul. 1, 1995 –Sep. 30, 1996.

"Utility Advanced Turbine Systems (ATS) Technology Readiness Testing", Phase 3R, Annual Technical Progress Report, Reporting Period: Oct. 1, 1997 –Sep. 30, 1998.

"Utility Advanced Turbine Systems (ATS) Technology Readiness Testing", Document #750405, Oct. 1 –Dec. 30, 1998, Publication Date: May, 1, 1999, Report Numbers: DE–FC21–95MC31176–20.

"Utility Advanced Turbine Systems (ATS) Technology Readiness Testing", Document #1348, Apr. 1 –Jun. 29, 1998, Publication Date Oct. 29, 1998, Report Numbers DE–FC21–95MC31176—18.

"Utility Advanced Turbine Systems (ATS) Technology Readiness Testing Phase 3", Annual Technical Progress Report, Reporting Period: Oct. 1, 1996 –Sep. 30, 1997.

"Utility Advanced Turbine Systems (ATS) Technology Readiness Testing and Pre–Commercial Demonstration", Quarterly Report, Jan. 1 –Mar.31, 1997, Document #666275, Report Numbers: DOE/MC/31176–07.

"Proceedings of the 1997 Advanced Turbine Systems", Annual Program Review Meeting, Oct. 28–29, 1997.

* cited by examiner

Fig. 2
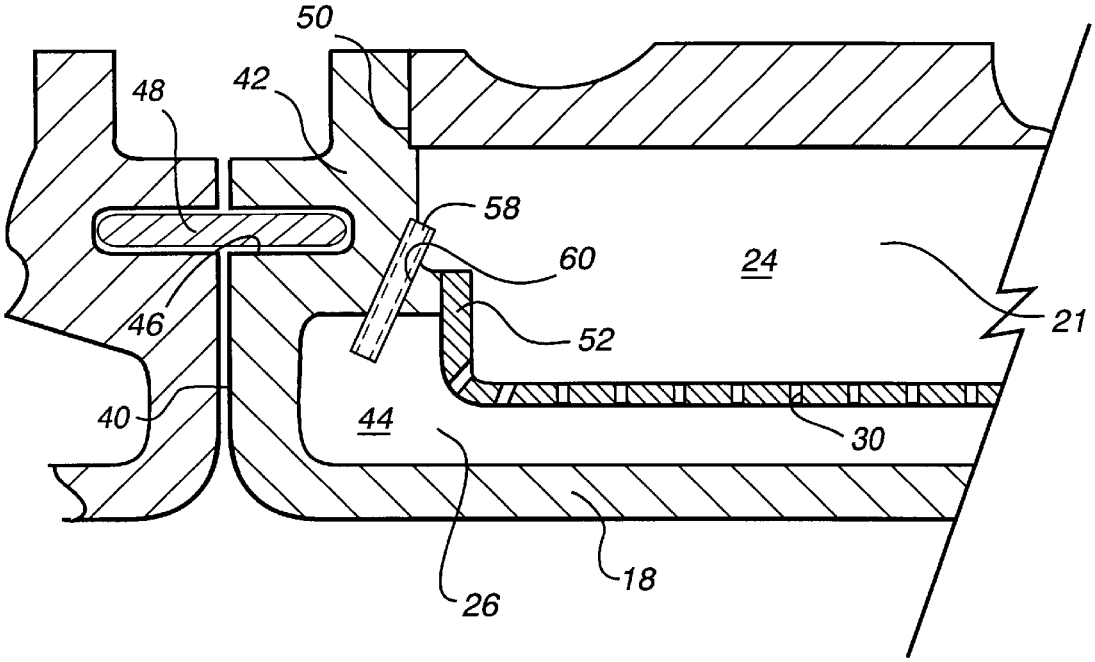
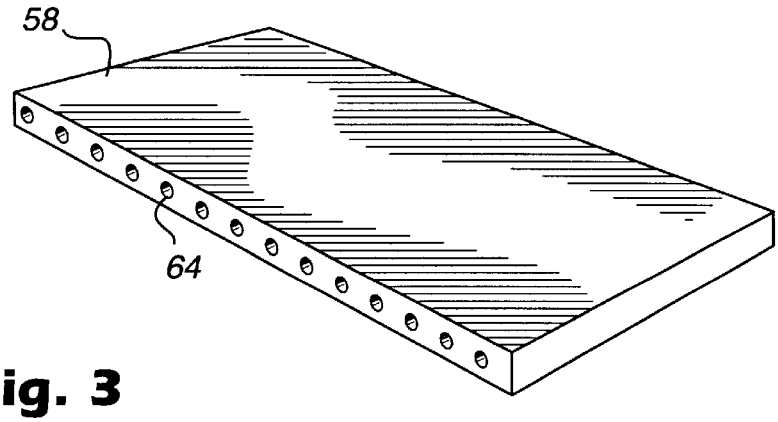
Fig. 3

APPARATUS FOR IMPINGEMENT COOLING A SIDE WALL ADJACENT AN UNDERCUT REGION OF A TURBINE NOZZLE SEGMENT

This invention was made with Government support under Contract No. DE-FC21-95MC311876 awarded by the Department of Energy. The Government has certain rights in this invention.

BACKGROUND OF THE INVENTION

The present invention relates to impingement cooling of a gas turbine nozzle band side wall adjacent an undercut region of a nozzle segment and particularly relates to impingement cooling of the nozzle band side wall in a design where the weld joint between the nozzle segment cover and the nozzle side wall is remote from the nozzle wall exposed to the hot gas path.

In current gas turbine designs, nozzle segments are typically arranged in an annular array about the rotary axis of the turbine. The array of segments forms outer and inner annular bands and a plurality of vanes extend between the bands. The bands and vanes define in pan the hot gas path through the gas turbine. Each nozzle segment comprises an outer band portion and an inner band portion and one or more nozzle vanes extend between the outer and inner band portions. In current gas turbine designs, a cooling medium, for example, steam, is supplied to each of the nozzle segments. To accommodate the steam cooling, each band portion includes a nozzle wall in part defining the hot gas path through the turbine, a cover radially spaced from the nozzle wall defining a chamber therewith and an impingement plate disposed in the chamber. The impingement plate defines with the cover a first cavity on one side thereof for receiving cooling steam from a cooling steam inlet. The impingement plate also defines, along an opposite side thereof and with the nozzle wall, a second cavity. The impingement plate has a plurality of apertures for flowing the cooling steam from the first cavity into the second cavity for impingement cooling the nozzle wall. The cooling steam then flows radially inwardly through cavities in the vane(s), certain of which include inserts with apertures for impingement cooling the side walls of the vane. The cooling steam then enters a chamber in the inner band portion and reverses its flow direction for flow radially outwardly through an impingement plate for impingement cooling the nozzle wall of the inner band. The spent cooling medium flows back through a cavity in the vane to an exhaust port of the nozzle segment.

The cover provided in each of the outer and inner band portions is preferably welded to the corresponding nozzle side wall. In prior designs, the weld joint between the cover and the nozzle wall was disposed at a radial location between the nozzle wall and the spline seal between side walls of adjacent nozzle segments. In that location, the weld joint was exposed to the high temperature gases in the hot gas flow path and the side wall was very difficult to cool. Thus, weld joint fatigue life was significantly reduced due to its proximity to the hot gas path. Moreover, the location of the weld was not optimum for manufacturing repeatability and was very sensitive to manufacturing tolerances. The weld joint was characterized by variable wall thicknesses which increased the stress at the joint, decreased the low cycle fatigue and limited the life of the parts. The wall thickness at the weld after machining was also a variable which could not be tolerated in the manufacturing process.

BRIEF SUMMARY OF THE INVENTION

In accordance with a preferred embodiment of the present invention, a cooling system is provided in a nozzle segment design in which the weld joint between the cover and nozzle side wall is on the side of the spline seal remote from the nozzle wall exposed to the hot gas path. That is, the weld joint between the cover and the nozzle side wall of the outer band is located radially outwardly of the spline seal between adjacent outer bands while the weld joint between the cover and the nozzle side wall of the inner band is located radially inwardly of the spline seal between adjacent inner bands. This reduces the temperature of the weld joints during turbine operation, reduces the stresses across the joints, both thermal and mechanical, eliminates any requirement for machining after welding and results in joints of constant thickness and higher fatigue life. The location also leads to improved machinability and tolerance to weld defects.

To provide that weld location, undercut regions adjacent the side walls of each nozzle segment bands are formed. Particularly, each undercut region includes a side wall or edge of the nozzle segment and an inturned flange extending inwardly from and generally parallel to the nozzle wall (in the hot gas path) and spaced from the nozzle wall. Cooling the nozzle side wall or edge, however, is quite difficult in view of the undercut region which spaces the side wall or edge a substantial distance from the nearest apertures of the impingement plate. This substantial distance from the impingement cooling flow reduces the effectiveness of the cooling of the nozzle side wall. It is therefore very important to minimize the impingement distance, i.e., the distance between the apertures through the impingement plate and the surface to be cooled. It is also necessary to minimize that distance in a producible production nozzle segment.

In accordance with the present invention, improved side wall fabrication and cooling is provided. Particularly, with the weld joint between the cover and the nozzle side wall located remotely from the hot gas path through the turbine, side wall cooling is improved by providing the inturned flange of the nozzle side wall with a plurality of openings in which apertured cooling plates are received. The apertures through the plates extend between opposite edges of the plate. Consequently, by inserting the plate into openings along the inturned flange of the side wall, one edge of the plate lies in communication with the first cavity, while the opposite edge lies in communication with the second cavity. Most importantly, however, the ends of the cooling flow exit apertures lie very close to the side wall. Consequently, cooling medium flow from the first cavity through the apertures into the second cavity exits the apertures at locations directly adjacent the side wall of the nozzle to be cooled. The free flow of the cooling medium therefore travels a limited distance insufficient for the flow exiting the apertures to spread. Also, because the apertures are elongated, i.e., extend between opposite edges of the plate, the cooling medium flowing from the apertures onto the side wall is more directed and focused, thereby increasing cooling efficiency.

In a preferred embodiment according to the present invention, there is provided for use in a gas turbine, a nozzle segment having outer and inner band portions and at least one vane extending between the band portions, at least one of the band portions including a nozzle wall defining in part a hot gas path through the turbine, a cover radially spaced from the nozzle wall defining a chamber therebetween and an impingement plate disposed in the chamber defining with the cover a first cavity on one side thereof for receiving a cooling medium, the impingement plate on an opposite side thereof defining with the nozzle wall a second cavity, the impingement plate having a plurality of apertures therethrough for flowing cooling medium from the first cavity into the second cavity for impingement cooling the nozzle wall, the nozzle segment including a side wall extending generally radially between the nozzle wall and the cover, means carried by the segment having a plurality of apertures therethrough for flowing the cooling medium from the first cavity for impingement cooling the side wall of the nozzle segment.

In a further preferred embodiment according to the present invention, there is provided for use in a gas turbine, a nozzle segment having outer and inner band portions and at least one vane extending between the band portions, at least one of the band portions including a nozzle wall defining in part a hot gas path through the turbine, a cover radially spaced from the nozzle wall defining a chamber therebetween and an impingement plate disposed in the chamber defining with the cover a first cavity on one side thereof for receiving a cooling medium, the impingement plate on an opposite side thereof defining with the nozzle wall a second cavity, the impingement plate having a plurality of apertures therethrough for flowing cooling medium from the first cavity into the second cavity for impingement cooling the nozzle wall, the nozzle segment including a side wall extending generally radially between the nozzle wall and the cover and having an inturned flange defining an undercut region adjacent the side wall, the impingement plate having an edge secured to the inturned flange, the inturned flange having at least one slot therethrough between the first cavity and the undercut region, a plate disposed in the slot and extending into the undercut region, and a plurality of apertures passing through the plate for flowing the cooling medium from the first cavity into the undercut region for impingement cooling the side wall of the nozzle segment.

BRIEF DESCRIPTION OF THE DRAWINGS

FIG. 2 is an enlarged fragmentary cross-sectional view illustrating a joint between side walls of adjacent nozzle segments further illustrating the location of the cover/nozzle casting weld joint and impingement cooling of the preferred embodiment hereof; and FIG. 3 is a perspective view of the apertured plate for nozzle side wall cooling in accordance with a preferred form of the present invention.

DETAILED DESCRIPTION OF THE INVENTION

Figure 1:
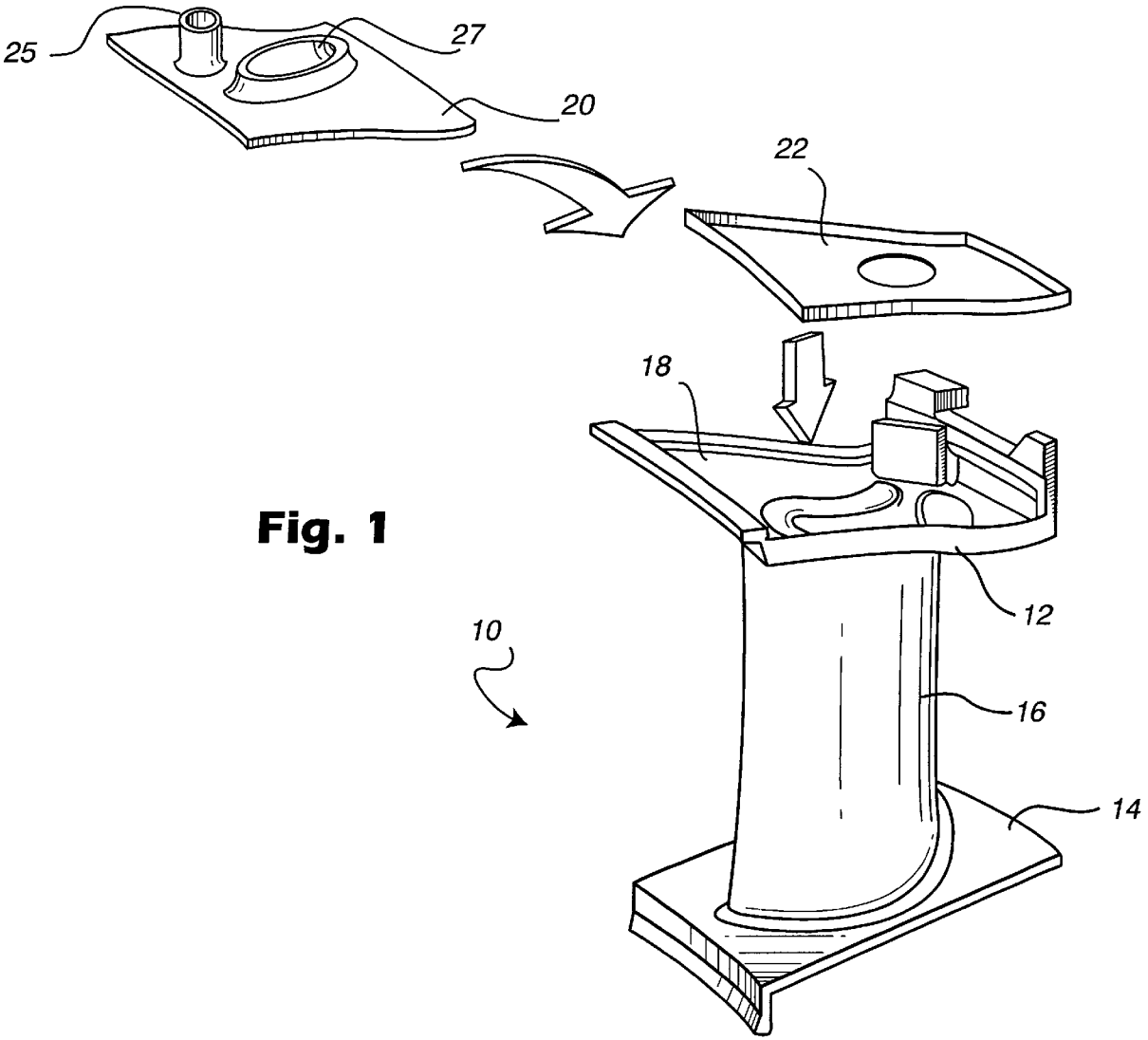
FIG. 1 is an exploded perspective and schematic view of a nozzle segment constructed in accordance with a preferred embodiment of the present invention.

Referring now to FIG. 1, there is illustrated a nozzle segment, generally designated 10, forming a part of an annular array of segments disposed about a gas turbine axis. Each nozzle segment includes an outer band 12, an inner band 14 and one or more vanes 16 extending therebetween. When the nozzle segments are arranged in the annular array, the outer and inner bands 12 and 14 and vanes 16 define an annular hot gas path through the gas turbine, as is conventional.

The outer and inner bands and the vanes are cooled by flowing a cooling medium, e.g., steam, through a chamber of the outer band 12, radially inwardly through cavities in the vanes, through a chamber in the inner band 14 and radially outwardly through the vanes for return of the cooling medium to an exit port along the outer band. More particularly and by way of example in FIG. 1, the outer band 12 includes an outer nozzle wall 18, an outer cover 20 which is disposed over and welded to the outer wall 18 to define a chamber 21 (FIG. 2) therebetween and an impingement plate 22 disposed in the chamber 21. The impingement plate 22 defines with the nozzle segment cover 20 a first cavity 24 and, on an opposite side thereof, defines with the nozzle wall 18 a second cavity 26. Cooling medium inlet and outlet ports 25 and 27, respectively, are provided through the cover for supplying the cooling medium, e.g., steam, to the nozzle vane segment and exhausting the spent cooling steam from the segment. The cooling steam is supplied to the first cavity 24 for passage through a plurality of apertures 30 in the impingement plate 22 for impingement cooling of the nozzle wall 18. The impingement cooling steam flows from the second cavity 26 into one or more inserts (not shown) in cavities extending through the vane between the outer and inner bands. The vane inserts include a plurality of apertures for impingement cooling of the side walls of the vane. The cooling steam then flows into the chamber of the inner band 14 and particularly into the radial innermost cavity for flow through apertures of an impingement plate in the inner band for impingement cooling the side wall of the inner band. The spent cooling steam then flows through a cavity in the vane and through the exhaust port of the outer band. For a complete description of an embodiment of the foregoing described cooling circuit, reference is made to U.S. Pat. No. 5,634,766, of common assignee, the disclosure of which is incorporated herein by reference.

Referring now to FIG. 2, there is illustrated a joint between adjacent nozzle segments. It will be appreciated that while the following description is specific with reference to the outer band 12, it is equally applicable to the inner band 14. Thus, each nozzle band (both inner and outer bands) includes a nozzle side wall or edge 40 which extends generally radially between the nozzle wall 18 and the cover 20. The band also includes an inturned flange 42 spaced from the nozzle wall 18 and defines with wall 18 and side wall or edge 40 an undercut region 44. The inturned flange 42 also includes a circumferentially opening slot 46 for receiving one edge of a spline 48 forming a seal between adjacent nozzle segments.

As Illustrated in FIG. 2, the covers 20 are welded to the inturned flanges 42 along opposite edges of the nozzle band. Also, the weld joint 50 lies on the side of the spline seal 48 remote from the nozzle wall 18. By locating the weld joint 50 away from the hot gas path defined in part by nozzle wall 18, the weld joint 50 is subjected to a much lower temperature than if located closer to the hot gas path. Also illustrated in FIG. 2 is the impingement plate 22 which has a turned flange 52 along opposite margins. Flange 52 is brazed or welded to an inside surface of the inturned flanges 42. While apertures 30 are located in each turned flange 52 of the impingement plate, it will be appreciated that there is a substantial distance between the nearest aperture 30 and the side wall or edge 40 in the undercut region 44. This large distance diminishes the effectiveness of the impingement cooling.

To minimize the impingement distance, i.e., the distance between the flow exiting the impingement cooling aperture nearest the surface to be cooled, means carried by the nozzle segment having a plurality of apertures therethrough are provided for flowing the cooling medium from the first cavity 24 for impingement cooling the side wall 40 of the segment. Such means may include a series of discrete tubes carrying the cooling medium and preferably include one or more plates 58 disposed in slots 60 formed in the inturned flange 42 of the nozzle side wall 40. The slots 60 are formed at an angle directed toward the side wall 40, A cooling plate 58 is disposed in each of the slots 60. As illustrated in FIGS. 2 and 3, each plate 58 has a plurality of apertures 64 which extend through the plate between opposite edges. Thus, the plate, as illustrated in FIG. 3, is generally rectilinear with length, width and depth dimensions and has apertures 64 formed in the plate between opposite long edges thereof and in a plane defined by the length and width dimensions. As best illustrated in FIG. 2, the apertures 64 lie in communication at one end with the cooling medium in the first cavity 24. The apertures along the opposite edge of the plate open into the second cavity 26. Thus, cooling medium flows through the apertures 64 from the first cavity 24 into the second cavity 26. Because the slots 60 are angled toward the side wall 40 and the plates are disposed in the slots at the same angular inclination, it will be appreciated that the cooling medium flow exiting the apertures 64 in the second cavity lies close to the side wall 40. Additionally, because the cooling medium flows along the length of the apertures and their length-to-diameter ratios are substantial, the flow is focused and directed onto the side wall and does not diverge substantially from the flow through the apertures.

To fabricate this improved side wall cooling system, the slots 60 are formed in the inturned flange 42 in the initial casting of the nozzle segment 10. Alternatively, the slots 60 may be machined into the inturned flange 42. After formation of the slots 40, the impingement plate 22 with its turned flanges 52 is placed into the nozzle segment and tacked into position. The impingement plate 22 is then welded into the nozzle. If the impingement plate were to be brazed into the nozzle, the holed plates 58 could be added at this time and brazed along with the impingement plate 22 to the segment. The slots for the hold plates are machined, for example, by EDM, into position prior to or after the impingement plate is in place, depending upon which method is used to connect the impingement plate to the nozzle segment. The apertures through the holed plates are preferably formed prior to the plates being secured into the inturned flange 42. It will be appreciated that the cooling system for the side wall of the nozzle segments described is applicable to both the outer and inner bands of the nozzle segments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use in a gas turbine, a nozzle segment having outer and inner band portions and at least one vane extending between said band portions, at least one of said band portions including a nozzle wall defining in part a hot gas path through the turbine, a cover radially spaced from said nozzle wall defining a chamber therebetween and an impingement plate disposed in said chamber defining with said cover a first cavity on one side thereof for receiving a cooling medium, said impingement plate on an opposite side thereof defining with said nozzle wall a second cavity, said impingement plate having a plurality of apertures therethrough for flowing cooling medium from said first cavity into said second cavity for impingement cooling said nozzle wall, said nozzle segment including a side wall extending generally radially between said nozzle wall and said cover, means carried by said segment having a plurality of apertures therethrough for flowing the cooling medium from said first cavity for impingement cooling said side wall of said nozzle segment.

2. A nozzle segment according to claim 1 wherein said cooling medium flowing means includes a plate with said apertures extending through said plate.

3. A nozzle segment according to claim 2 wherein said plate has length, width and depth dimensions, said apertures extending generally in a plane defined by said length and width dimensions and between opposite edges of said plate.

4. A nozzle segment according to claim 2, wherein said side wall has an inturned flange defining an undercut region adjacent said side wall, plural slots opening through and spaced from one another along said inturned flange, a plate disposed in each said slot and extending into said undercut region and a plurality of apertures passing through said plates for flowing the cooling medium from said first cavity into said undercut region for impingement cooling said side wall of said nozzle segment.

5. A nozzle segment according to claim 1 wherein said cover is welded to said nozzle side wall.

6. For use in a gas turbine, a nozzle segment having outer and inner band portions and at least one vane extending between said band portions, at least one of said band portions including a nozzle wall defining in part a hot gas path through the turbine, a cover radially spaced from said nozzle wall defining a chamber therebetween and an impingement plate disposed in said chamber defining with said cover a first cavity on one side thereof for receiving a cooling medium, said impingement plate on an opposite side thereof defining with said nozzle wall a second cavity, said impingement plate having a plurality of apertures therethrough for flowing cooling medium from said first cavity into said second cavity for impingement cooling said nozzle wall, said nozzle segment including a side wall extending generally radially between said nozzle wall and said cover and having an inturned flange defining an undercut region adjacent said side wall, said impingement plate having an edge secured to said inturned flange, said inturned flange having at least one slot therethrough between said first cavity and said undercut region, a plate disposed in said slot and extending into said undercut region, and a plurality of apertures passing through said plate for flowing the cooling medium from said first cavity into said undercut region for impingement cooling said side wall of said nozzle segment.

7. A nozzle segment according to claim 6 wherein said plate has length, width and depth dimensions, said apertures extending generally in a plane defined by said length and width dimensions and between opposite edges of said plate.

8. A nozzle segment according to claim 6 including a plurality of slots opening through and spaced from one another along said inturned flange, a plurality of plates being disposed in said slots, respectively, and extending into said undercut region and a plurality of apertures passing through each plate for flowing the cooling medium from said first cavity into said undercut region for impingement cooling said side wall of said nozzle segment.

9. A nozzle segment according to claim 6 wherein said cover is welded to said nozzle side wall.

10. A nozzle segment according to claim 6 wherein exit openings for the apertures in the plate lie closer to the side wall than apertures through the impingement plate.

* * * * *

UNITED STATES PATENT AND TRADEMARK OFFICE

CERTIFICATE OF CORRECTION

PATENT NO. : 6,419,445 B1
DATED : July 16, 2002
INVENTOR(S) : Burdgick

It is certified that error appears in the above-identified patent and that said Letters Patent is hereby corrected as shown below:

Column 1,
Line 24, change “pan” to -- part --;

Column 6,
Line 13, change “2” to -- 1 --.

Signed and Sealed this

Twenty-first Day of January, 2003

JAMES E. ROGAN
*Director of the United States Patent and Trademark Office*